US005089669A

United States Patent [19]

Piper et al.

[11] Patent Number: 5,089,669

[45] Date of Patent: Feb. 18, 1992

[54] MULTI-CONDUCTOR ELECTRICAL TRANSMISSION RIBBON CABLE WITH VARIABLE CONDUCTOR SPACING

[75] Inventors: Douglas E. Piper, Greenville; E. J. Mondor, III, Taylors, both of S.C.

[73] Assignee: Woven Electronics Corporation, Mauldin, S.C.

[21] Appl. No.: 552,947

[22] Filed: Jul. 16, 1990

[51] Int. Cl.[5] ..... H01B 7/08; H01B 13/00; D03D 15/00

[52] U.S. Cl. ..... 174/117 M; 29/857; 139/425 R; 156/51; 439/498; 439/502

[58] Field of Search ..... 174/117 M, 117 F, 117 FF, 174/117 R; 139/425 R; 29/857; 439/492, 498, 502; 156/51

[56] References Cited

U.S. PATENT DOCUMENTS

| | | | |
|---|---|---|---|
| 3,523,844 | 8/1970 | Crimmins et al. | 174/52 |
| 3,633,189 | 1/1972 | Billawain | 174/117 FF X |
| 3,914,531 | 10/1975 | Zell et al. | 174/36 |
| 4,143,236 | 3/1979 | Ross et al. | 174/32 |
| 4,229,615 | 10/1980 | Orr, Jr. et al. | 174/117 F X |
| 4,255,853 | 3/1981 | Campillo et al. | 174/117 F X |
| 4,548,661 | 10/1985 | Escallier et al. | 174/117 F X |
| 4,664,459 | 5/1987 | Flanagan et al. | 174/117 FF X |
| 4,682,828 | 7/1987 | Piper et al. | 29/857 X |
| 4,712,298 | 12/1987 | Mondor, III | 29/861 |
| 4,741,707 | 5/1988 | Mondor, III | 174/117 M X |
| 4,746,769 | 5/1988 | Piper | 174/115 X |
| 4,777,326 | 10/1988 | Zamborelli | 174/36 |
| 4,879,433 | 11/1989 | Gillett et al. | 174/32 |

FOREIGN PATENT DOCUMENTS

| | | | |
|---|---|---|---|
| 195611 | 8/1989 | Japan | 174/117 F |

*Primary Examiner*—Morris H. Nimmo
*Attorney, Agent, or Firm*—Cort Flint

[57] ABSTRACT

A high density multi-conductor ribbon cable (A, A', 40, 56', 65, 65', 90, 90') is disclosed having a variable width and variable center spacing (X) of conductors (12) along the cable length. The spacing of conductors (12) is determined by the vertical position of a tapered reed (B) and the cable may be extruded (40) or woven (56). Variations in the width and spacing of the signal conductors may be had to match mechanical and/or electrical characteristics of associated terminal connectors (22, 68, 68') and input and output devices (26, 28).

29 Claims, 6 Drawing Sheets

24
28
7B
7B
20
16
F
28
26
A
10
14
18
7A
7A
22
26

12
16
X2
26
28

18
26
X1
12
28

28
16
20
A'
F
14
18
26
22

MULTI-CONDUCTOR ELECTRICAL TRANSMISSION RIBBON CABLE WITH VARIABLE CONDUCTOR SPACING

BACKGROUND OF THE INVENTION

The invention relates to high density, multi-conductor ribbon cable and connectors for high speed electrical signal transmissions. In particular, the invention relates to this type of cable where the spacing between centers of the conductor wires may be varied at different lengths of the cable so that mechanical and electrical characteristics may be matched to those of external devices such as input or output devices or terminal connectors.

Previously, multi-conductor ribbon cable has been manufactured with the space between the centers of the conductor wires specified in order to meet the requirements of the terminal connectors. In one type of connector, insulation displacement connectors (IDC), this spacing may range from 100 mils to 25 mils. The electricals of the cable is determined by the spacing of the conductors as required by the IDC. Other multi-conductor ribbon cable with different spacings can be terminated and connected to terminal connector by using a printed circuit board (PCB). The PCB makes the transition from the spacing of the conductors of the ribbon cable to the connector spacings. However, with the advent of miniaturized electronics equipment, connectors are being reduced in size. For the IDC cable to match the connector size, the electrical impedance of the cable will be further reduced as the conductors move closer together. The increased capacitance may degrade the signal quality in many cases. In many other applications, a ribbon cable may be attached between an output device and an input device. The impedance of the output and input devices may be different. In many applications, it is desirable for the cable to be terminated with an impedance which matches the associated output or input devices. In prior multi-conductor ribbon cable, the constant spacing of the conductor along the cable length fixes the impedance characteristic, and it is the same at both ends of the cable. This means that there will be a mismatched impedance at one end of the cable with the associated input or output device. For example, U.S. Pat. No. 4,143,236 discloses a multi-conductor ribbon cable wherein the center spacings of the signal conductors are fixed by weaving warp and weft yarns in a fabric which fixes the spacing of the signal conductors to produce a controlled impedance characteristic. However, the spacing of the conductors is constant along the length of the cable so that the impedance at the ends of the cable is essentially the same.

Accordingly, an object of the invention is to provide a multi-conductor ribbon cable in which a center spacing of the conductors may be varied along the length of the cable to provide desired mechanical and/or electrical characteristics.

Another object of the invention is to provide multi-conductor ribbon cable having different center spacings of the conductors to mechanically meet the specifications of an electrical connector in which the cable is being terminated.

Another object of the invention is to provide a multi-conductor ribbon cable having conductors with different center spacings at the terminal ends of the cable to match different mechanical and/or electrical characteristics of associated input and output devices.

Another object of the invention is to provide a multi-conductor ribbon cable having a greater center spacing of the signal conductors in an intermediate body portion of the cable than at the terminal ends of the cable.

Another object of the invention is to provide a high density multi-conductor ribbon cable having a variable center spacing of the conductors along its length so that the cable may be contoured to meet mechanical specifications demanded by routing the cable in an associated chassis.

Another object of the invention is to provide a woven high density multi-conductor cable in which the center spacing of conductors is fixed by a woven fabric which may be varied and the tightness of the weave may be varied depending on the number of conductors in that portion of the fabric.

SUMMARY OF THE INVENTION

The above objectives are accomplished according to the invention by providing an electrical transmission cable which has different widths and conductor center spacings to provide variable mechanical and electrical characteristics to match those of associated terminal connectors and/or input and output devices. Preferably, the ribbon cable comprises a plurality of signal conductors which extend in a longitudinal direction in a generally side-by-side manner with a prescribed center spacing between the centers of the signal conductors. A plurality of warp yarns extend in a longitudinal direction and weft yarns extend in a transverse direction. The warp and weft yarns are woven with the longitudinal signal conductors to form a woven fabric and fix the center spacing of the signal conductors as it varies along the length or at different lengths of the cable. A compressed section of the cable is provided in which the signal conductors have a compressed center spacing. An expanded section of the signal conductors is provided in which the signal conductors have an expanded center spacing greater than the compressed center spacing. Terminal connectors connect a first end of the cable to an input device and second end of the cable to an output device. The signal conductors and warp and weft yarns may be woven in a multi-layer configuration in the compressed section for higher density. The signal conductors and the warp and weft yarns may be woven in a single or multi layer construction in the expanded section. A conductor break-out may be included where the signal conductors are removed from the woven fabric and excluded from the woven fabric. The warp and weft yarns are continued in a tight weave with the conductors removed. The tight weave includes the warp and weft yarns woven with a spacing which is closer together than the spacing of the warp and weft yarns in the weave of the woven fabric wherein the conductors are included. The tight weave forms a strain relief tab. A plurality of ground conductors may be included in the longitudinal direction in a generally side-by-side manner on opposed sides of the signal conductors. The ground conductors include a pair of juxtaposed ground conductors on each side of the signal conductors. The signal conductors may also include resistive conductors.

Electrical characteristics and mechanical characteristics are matched to associated input and output devices and connector assemblies, respectively. The signal conductors are spaced in a first section of the cable to provide a first electrical characteristic which matches an electrical characteristic of the input device. The signal conductors are spaced in a second section of the cable to provide a second center spacing and match an electrical characteristic of the output device. The cable may be woven so that it tapers or contours outwardly from the first section to the second section. Alternately, the cable may be woven so that the first section exists at first and second terminal ends of the cable and the second section is woven intermediate the first and second end to provide a lower capacitance cable, or any number or variances in the cable width and conductor spacings may be had depending on the application being made.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

Figure 7:
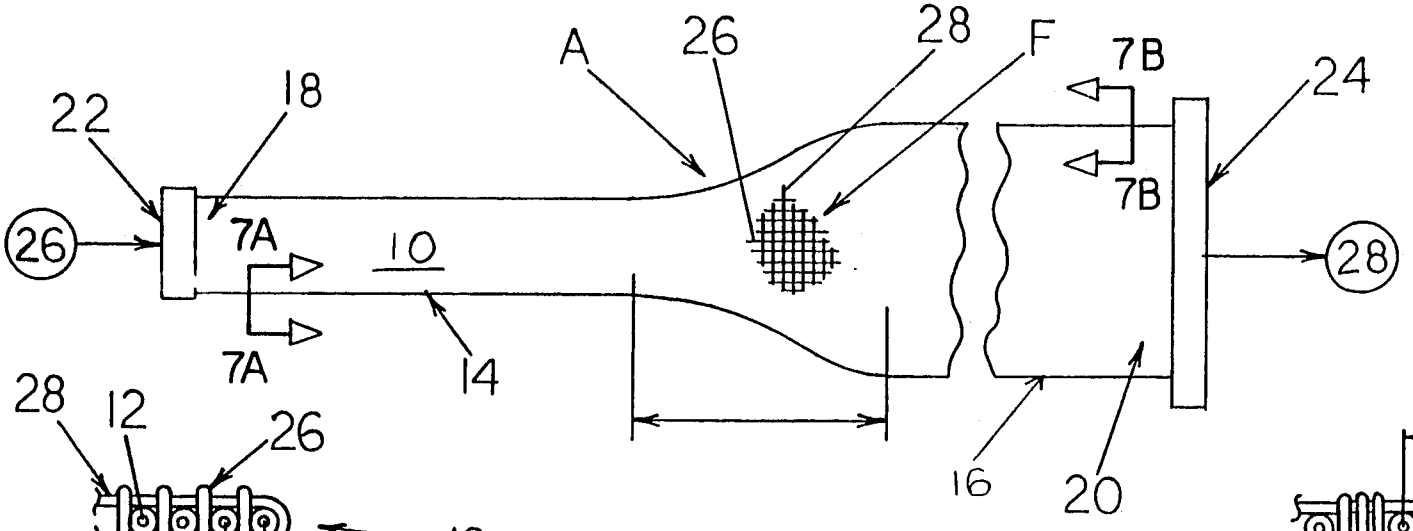
FIG. 7 is a plan view of a multi-conductor ribbon cable having a compressed and expanded width with variable spacing between signal conductors in accordance with the invention.

FIG. *7a* is a partial sectional view taken along line *7a–7a* of FIG. 7;

FIG. *7b* is a partial sectional view taken along line *7b–7b* of FIG. 7.

Figure 8:
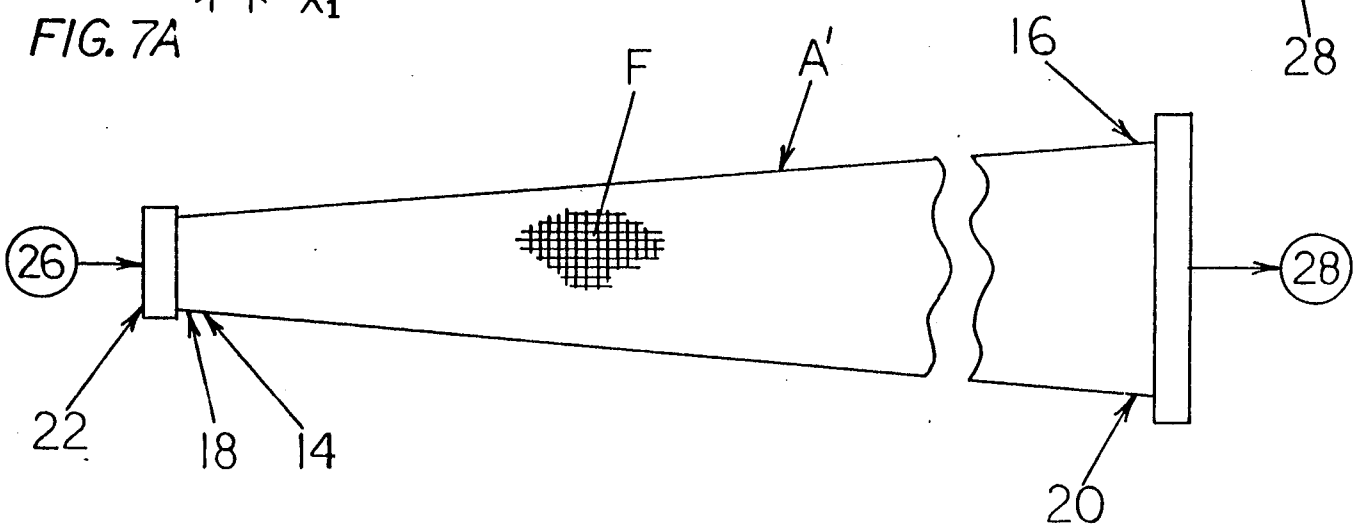
Figure 9:
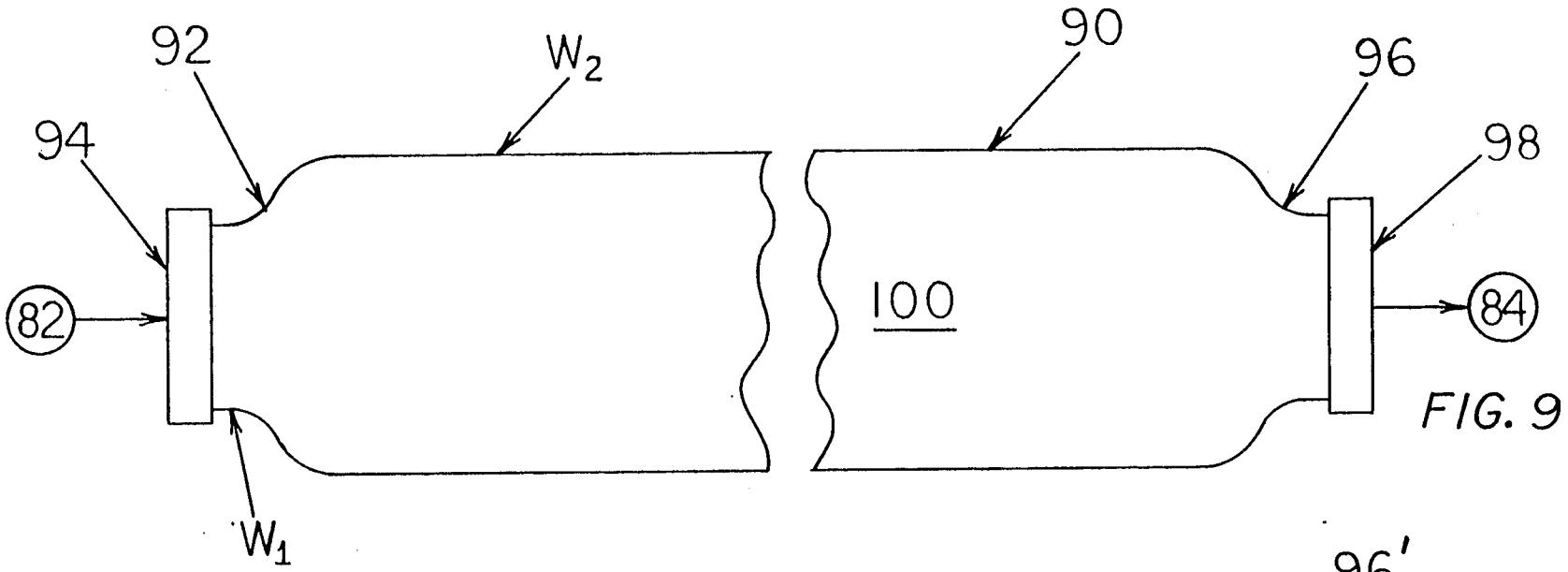
Figure 10:
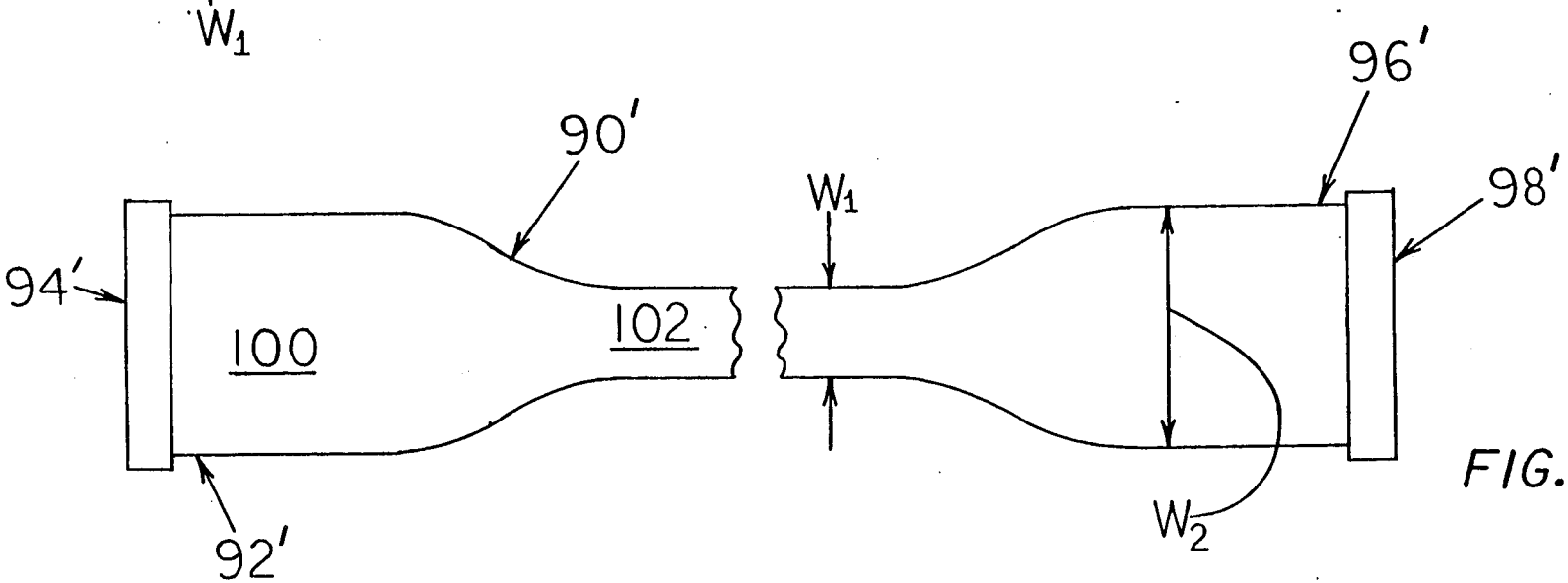
Figure 11:
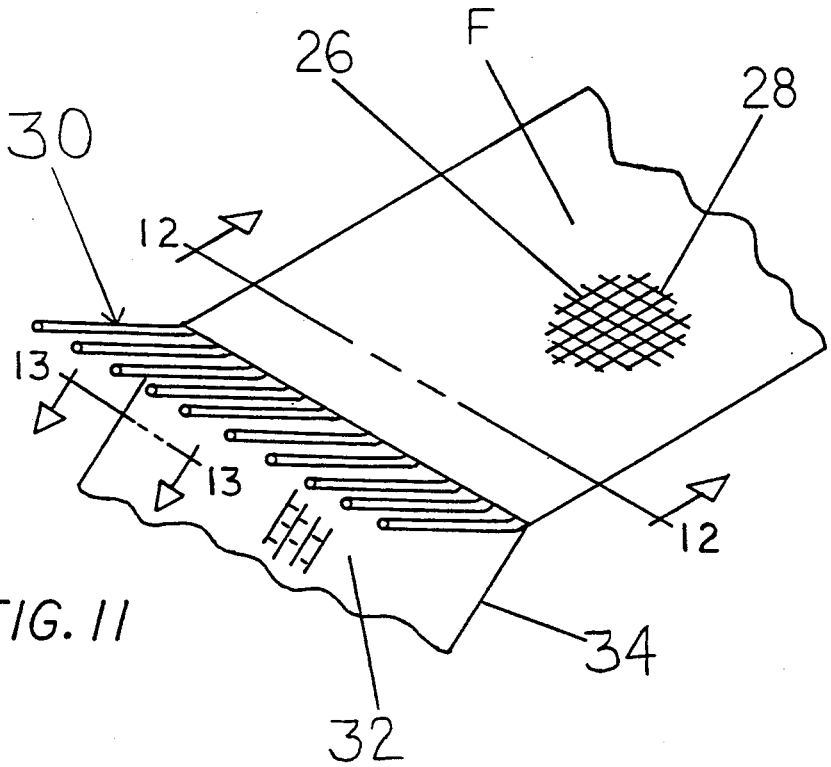
Figure 12:
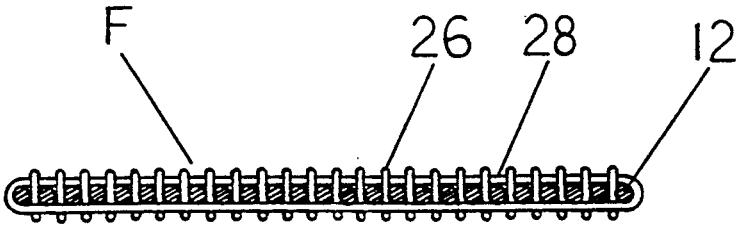

FIG. 8 is a plan view of a multi-conductor ribbon cable having a compressed and expanded width with variable spacing between signal conductors in accordance with the invention;

FIG. 9 is a plan view of a multi-conductor ribbon cable in accordance with the invention having a compressed width at each terminal end and an expanded width intermediate the ends to provide a low capacitance electrical characteristic for the cable;

FIG. 10 is a plan view of a multi-conductor ribbon cable according to the invention having a compressed width in the middle and expanded width at the ends with variable spacing between signal conductors;

FIG. 11 is a perspective view of an end of a multi-conductor ribbon cable according to the invention having conductors broken out with a strain relief tab woven with a more compacted weave than in the main body of the cable;

FIG. 12 is a sectional view taken along line 12—12 of FIG. 11; and

Figure 13:
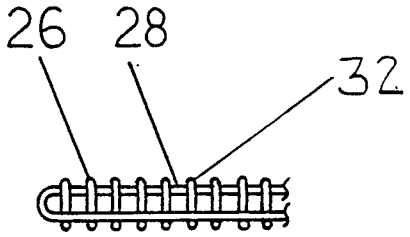

FIG. 13 is a sectional view taken along line 13—13 of FIG. 11.

DESCRIPTION OF A PREFERRED EMBODIMENT

Figure 1:
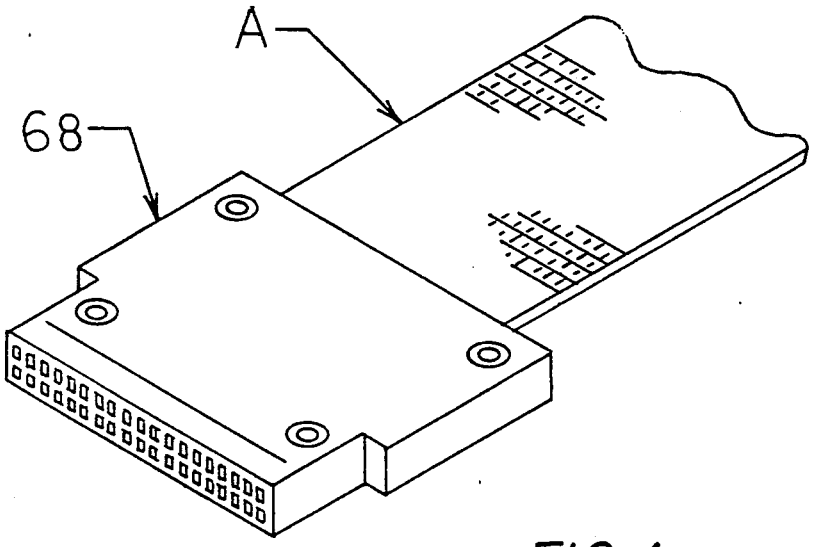
FIG. 1 is a perspective view illustrating a multi-conductor ribbon cable and printed circuit board terminal connector in accordance with the invention.
Figure 2:
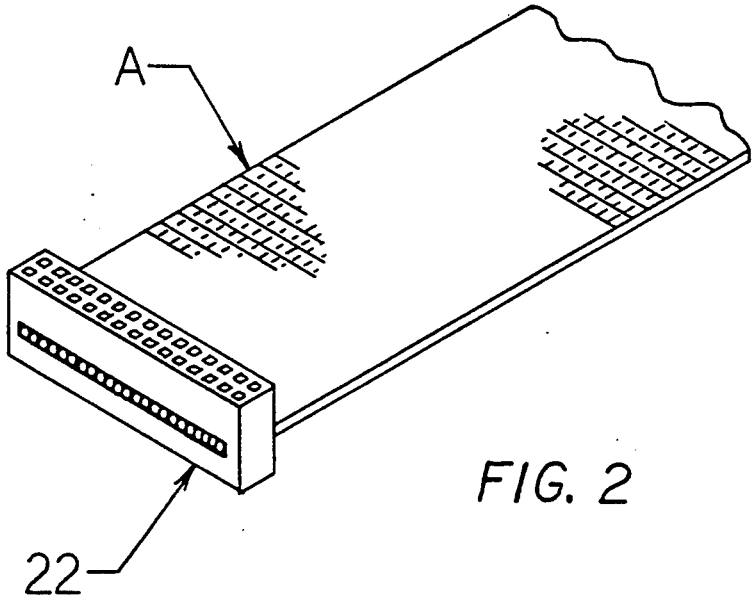
FIG. 2 is a multi-conductor ribbon cable according to the invention having an insulation displaceable connector.

Referring now in more detail to the drawings, a multi-conductor ribbon cable A is illustrated which includes a generally flat section 10 having a plurality of signal conductors 12 extending in a longitudinal direction in a generally side-by-side manner with a desired center spacing "X" between the signal conductors and means for fixing the center spacing of the signal conductors. As can best be seen in FIGS. 7 through 8, first section 14 of the signal conductors has compressed width $W_1$ with a first center spacing $X_1$, a second section 16 of the signal conductors has an expanded width $W_2$ with a second center spacing $X_2$. Second center spacing $X_2$ is greater than the first center spacing $X_1$ to provide desired mechanical and/or electrical cable characteristics. In FIGS. 7 and 8, first section 14 is at a first terminal end 18 of the cable, and second section 16 is at a second terminal end 20 of the cable. Cable A is terminated at a first electrical connector 22 first terminal end 18, and is terminated at a second electrical connector 24 second terminal end 20. As illustrated, connectors 22, 24 are insulation displaceable connectors (IDC), as can best be seen in FIG. 2. Connector 22 may be a 25 mil connector and connector 24 may be a 50 mil connector to accommodate the electricals of associated input and output devices 26 and 28, respectively. The means for fixing the center spacing of the conductors may comprise a woven fabric "F" having a weave which includes a plurality of warp yarns 26 extending in the longitudinal direction and weft yarns 28 interwoven with the warp yarns and the signal conductors 12. In this case, cable A may be a flat woven cable with termination as disclosed in U.S. Pat. Nos. 4,741,707, and 4,712,298 incorporated by reference.

Figure 4:
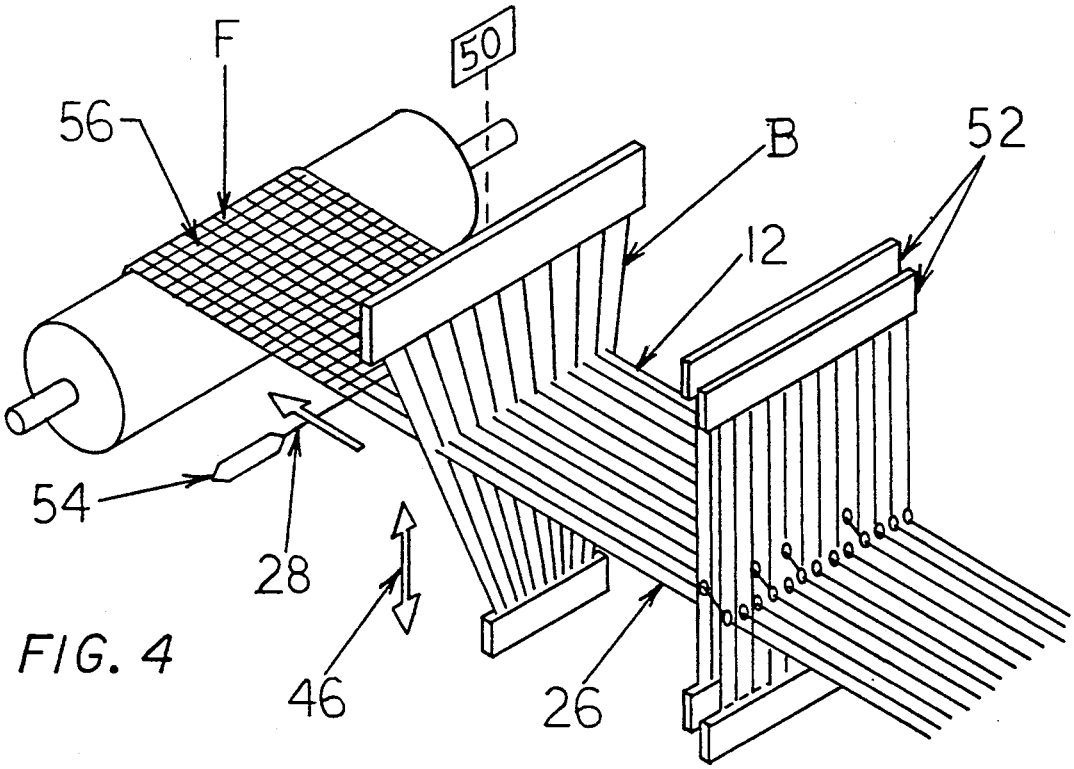
FIG. 4 is a perspective view illustrating apparatus and method for producing a multi-conductor ribbon cable with variable spacing between conductors along the length of the cable wherein the spacing of the conductors is fixed by weaving.
Figure 3:
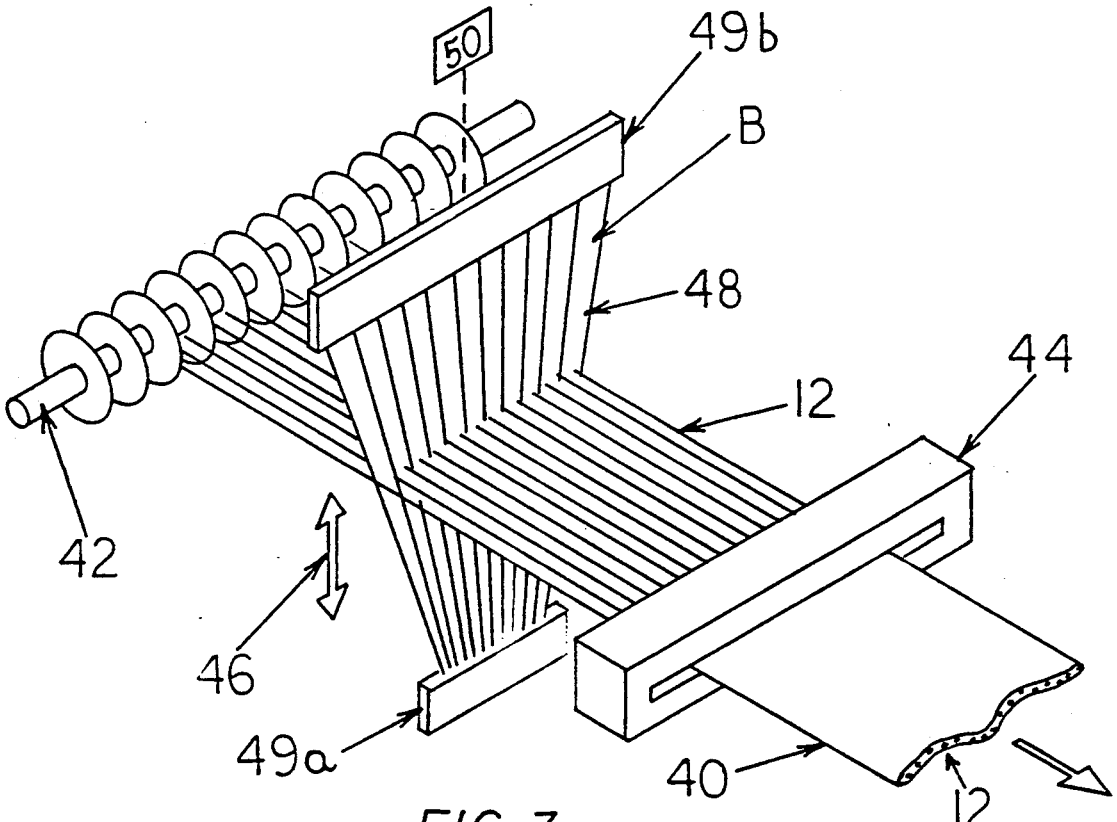
FIG. 3 is a perspective view illustrating apparatus and method for producing a multi-conductor ribbon cable with variable spacing between conductors along the length of the cable wherein the spacing of the conductors is fixed by lamination.

An apparatus and method for producing multi-conductor ribbon cable having different center spacings "X" between signal conductors 12 will now be described in reference to FIGS. 3 and 4. A laminated ribbon cable designated, generally as 40, is illustrated in FIG. 3. Signal conductors 12 are withdrawn from a spooling creel 42 and pass through an extruder 44 which laminates the conductors and fixes the center spacing in accordance with conventional techniques. Conventional laminated cable is disclosed in U.S. Pat. No. 3,914,531 incorporated by reference. In accordance with the present invention, a tapered reed, designated generally as B, is utilized which may be moved vertically in the direction of arrow 46. Reed B includes reed wires 48 set in a fan-shaped tapered pattern by slats 49*a*, 49*b*. The reed separates conductors 12 and determining the spacing between the conductors depending on the vertical position of the reed. Reed wires 48 bring signal conductors 12 closer together or further apart depending upon the vertical position of reed B to vary the center spacing of signal conductors 12 as fixed by the lamination process in extruder 44. Reed B may be positioned in accordance with any desired control 50 and programmed to vary the distance between signal conductors 12 and, hence there center spacing as desired for the particular application being made. In another embodiment of the invention, an apparatus and method for producing ribbon cable in a woven configuration is illustrated in FIG. 4. Signal conductors 12 coming from a creel (not shown) pass through heddle frames 52 as in a conventional loom. Warp yarns 26 may also be held in a conventional manner by heddle frames 52. Weft yarns 28 are inserted into sheds formed by the heddle frames by means of a shuttle 54. Tapered reed B beats the weft yarns up into the fabric in accordance with known techniques as in the case of a conventional feed-up reed. In this case, tapered reed B determines the spacing between signal conductors 12 and the center spacing of the signal conductors is fixed by the woven fabric. Warp yarns 26 also pass through the reed and are spaced by reed wires 48. The spacing between the warp yarns is also determined by the vertical portion of reed B. A suitable loom and tapered reed is manufactured by the Muller Corporation as needle weaving machine type NFRE 42 2/66Y2. Suitable conventional woven fabric and cable is illustrated in U.S. Pat. No. 4,143,236, incorporated by reference. This woven fabric includes one or more ground conductors carried between adjacent signal conductors to provide an associated ground wire on each side of the signal conductor. If a pair of ground conductors are provided between adjacent signal conductors then there is a pair of exclusive ground conductors on each side of each signal conductor which isolates the signal conductor and fixes the impedance value of each conductor wire at a desired impedance value so that the cable impedance characteristic may be accurately controlled.

Figure 5:
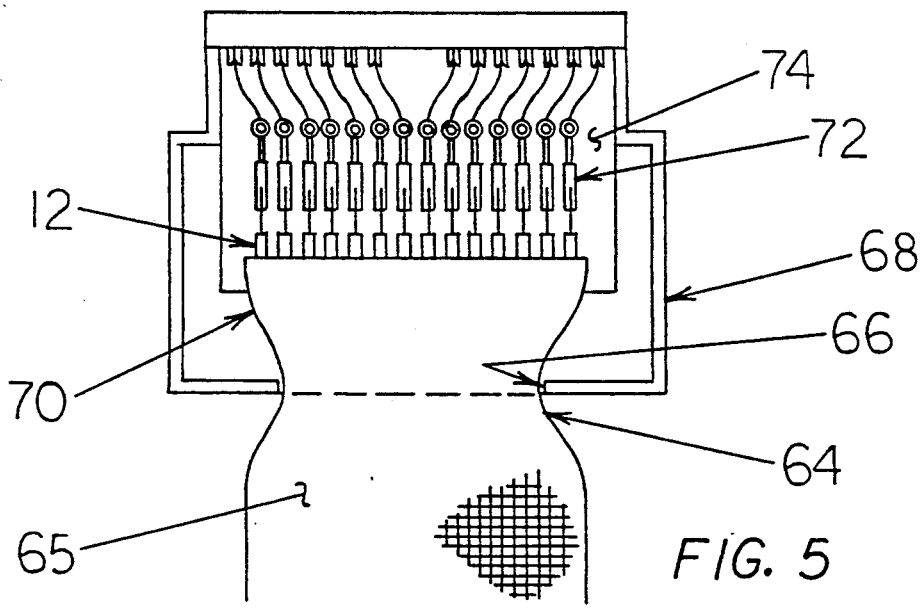
FIG. 5 is a top plan view of a multi-conductor ribbon cable with variable spacing between conductors terminated to a printed circuit board in accordance with the invention.
Figure 6:
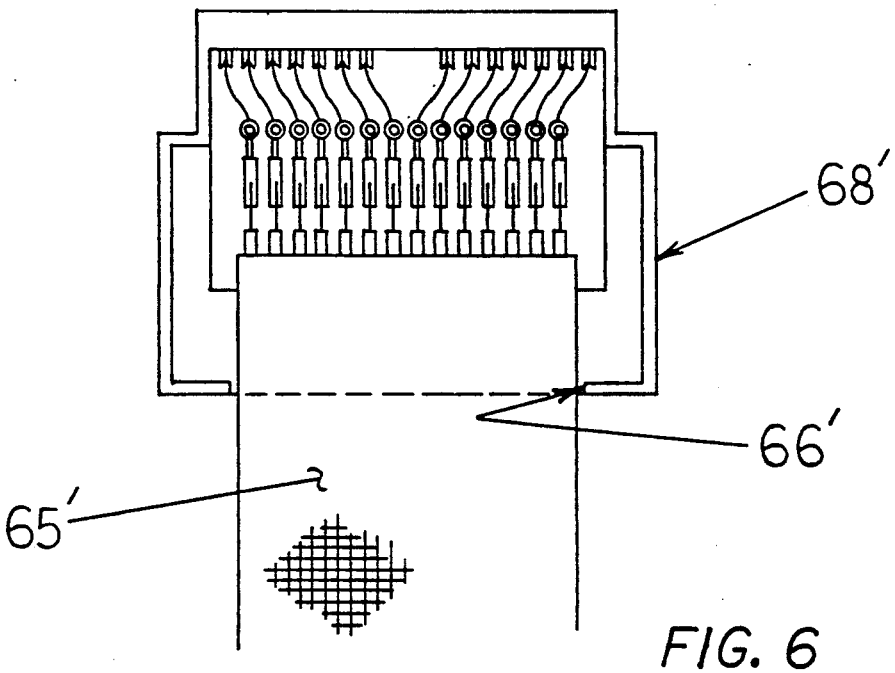
FIG. 6 is a top plan view of a multi-conductor ribbon cable with variable spacing between conductors terminated to a printed circuit board in accordance with the invention.

Having been taught apparatus and method for varying the center spacing between signal conductors in ribbon cable constructions, including laminated or woven constructions, different variations of ribbon cable will now be described. As can best be seen in FIGS. 11–13 woven conductor break-out 30 may be provided where signal conductors 12 are removed from woven fabric "F" and excluded from the woven fabric. Warp and weft yarns 26, 28 are continued in a tight weave 32 with the conductors removed. The tight weave includes the warp and weft yarns woven with a spacing which is closer together (FIG. 13) than the spacing of the warp and weft yarns in the weave of the woven fabric wherein the conductors are included (FIG. 12). The tight weave 32 again is provided by using tapered reed B to bring warp yarns 28 closer together in the tight weave as opposed to the cable fabric F. This tight weave forms a strain relief tab 34. Woven cable A may be produced having a tubular section which includes signal conductors 12 jacketed in a generally tubular weave formed in accordance with U.S. Pat. No. 4,229,615, incorporated by reference. In the tubular weave, warp and weft yarns 26, 28 are woven with a spacing which is closer together than the spacing of the warp and weft yarns in the weave of woven fabric "F", since the tubular weave merely jackets the conductors. As can best be seen in FIG. 5, the center spacing of signal conductors 12 may be compressed at 64 to provide a cable 65 which fits into a strain relief opening 66 of an associated electrical connector 68 of the printed circuit board (PCB) type. The center spacing is expanded at 70 to provide a center spacing which is greater than the center spacing at 64 to match a series of connector pads 72 carried by a printed circuit board 74 of PCB connector 68. This matching enhances the making of reliable connections in the tedious soldering step of termination. In FIG. 6, a PCB connector 68' has a strain relief slot opening 66' which matches the spacing of pads 72 so that compression of the conductor spacing and cable 65 is not needed. Cables 65, 65' are illustrated woven, but may also be extruded.

As can best be seen in FIGS. 9 and 10, a cable 90 may be produced which has a first end 92 for termination at a first electrical connector (IDC) 94 and second end 96 for termination at a second electrical connector (IDC) 98. The cable has compressed width $W_1$ at first and second ends 92, 96, and has expanded width $W_2$ at an intermediate main body portion 100. Main body portion 100 provides a low capacitance characteristic to the cable due to a wider spacing between conductors 12 than is permitted by terminal connectors 94, 98. Alternately, the variable spacing may permit a wider main body to make a transition to smaller connector sizes or pin numbers for miniaturization. In FIG. 10, a cable 90' is illustrated having an expanded width $W_2$ at first and second ends 92' and 96' with compressed $W_1$ at an intermediate portion 102 to accommodate electricals or mechanicals such as routing or other purposes.

Figure 7B:
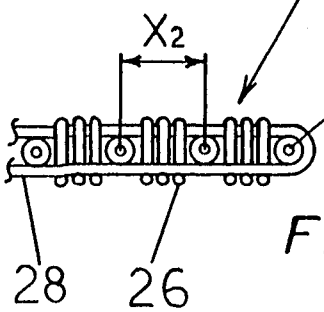
Figure 7A:
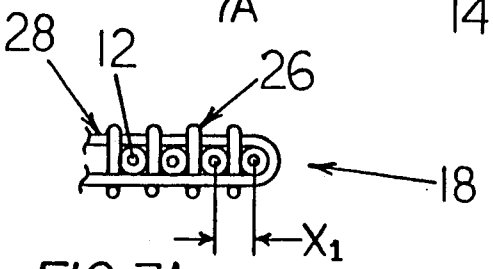

Preferably, the cables illustrated are formed as woven electrical transmission cable having different widths to provide variable mechanical and electrical characteristics as disclosed. The woven cables may be made in many constructions, such as those disclosed in the previously incorporated patent references, without departing from the essence of the invention. Signal conductors 12 extend in a longitudinal direction in a generally side-by-side manner with a prescribed center spacing "X" between the centers of the signal conductors, which center spacing may be made to vary along the length of the cable. (FIGS. 7–7B) The signal conductors may comprise resistive conductors as disclosed in U.S. Pat. No. 4,777,326, incorporated by reference. The cable may include compressed section $W_1$ in which the signal conductors have a compressed center spacing and expanded section $W_2$ in which the signal conductors have an expanded center spacing as various and different sections of the cable. Any number of different widths and spacings may be provided along the length of the cable by setting the position of tapered reed B. (FIG. 4) The signal conductors and warp and weft yarns may be woven in a multi-layer configuration in the compressed section. Signal conductors 12 and warp and weft yarns 16, 28 may be woven in multi-layer construction as disclosed in U.S. Pat. No. 4,746,769 incorporated by reference. A multi-layer construction is particularly useful in a cable section having a compressed width $W_1$ (FIG. 9–10 ) and a large number of conductors (high density). The expanded section may be woven in a single or multi-layer construction. A conductor break-out may be included where the signal conductors are excluded from the woven fabric and are disposed outside of the woven fabric. (FIG. 11) The warp and weft yarns are continued in a tight weave with the conductors removed. The tight weave includes the warp and weft yarns woven with a spacing which may be closer together than the spacing of the warp and weft yarns in the weave of the woven fabric wherein the conductors are included. A plurality of ground conductors may be included extending in the longitudinal direction in a generally side-by-side manner on opposed sides of the signal conductors. The ground conductors may include a pair of juxtaposed ground conductors on each side of the signal conductors as disclosed in U.S. Pat. No. 4,143,236.

In an electrical ribbon cable, a method is shown for matching electrical characteristics and/or mechanical characteristics to associated input and output devices 82, 84 and/or terminal connector assemblies. The cable is of the type which includes a plurality of signal conductors 12 extending in a longitudinal direction in a generally side-by-side manner with a prescribed center spacing "X" between the centers of the signal conductors. (FIGS. 7-8) The method comprises spacing the signal conductors in a first section of the cable to provide a first electrical characteristic which matches an electrical characteristic of an input device, and spacing the signal conductors in a second section of the cable to provide a second center spacing and match an electrical characteristic of an output device. The first and second center spacings of the cable are fixed. The method includes weaving a plurality of warp yarns and weft yarns in a with the signal conductors to fix the center spacings at the first and second sections. The method includes weaving the cable to fix the center spacing of the signal conductors where the center spacing $X_2$ is expanded in the second section relative to a compressed width $X_1$ in the first section. The method includes weaving the cable so that it tapers or contours outwardly from the compressed section to the expanded section. The method includes weaving the cable so that the compressed section exists at first and second terminal ends of the cable and the expanded section is woven intermediate the compressed ends. (FIGS. 9-10) The method includes weaving the cable at the terminal ends so conductor spacing matches the physical dimensions of electrical pads of an associated printed circuit board on which the signal conductors are terminated.

While a preferred embodiment of the invention has been described using specific terms, such description is for illustrative purposes only, and it is to be understood that changes and variations may be made without departing from the spirit or scope of the following claims.

What is claimed is:

1. A multi-conductor ribbon cable which includes a generally flat section having a plurality of signal conductors extending in a longitudinal direction in a generally side-by-side manner with a desired center spacing between said signal conductors; means for fixing said center spacing of said signal conductors; a first section of said signal conductors having a first center spacing, a second section of said signal conductors having a second center spacing, and said second center spacing being greater than said first center spacing to provide desired mechanical and electrical cable characteristics; and said means for fixing said center spacing of said conductors comprises a woven fabric having a weave which includes a plurality of warp yarns extending in said longitudinal direction and weft yarns interwoven with said warp yarns and said signal conductors.

2. The cable of claim 1 wherein said first section is at a first terminal end of said cable, and said second section includes a longitudinal section of said cable.

3. The cable of claim 1 wherein said cable has a first terminal end and a second terminal end at which said cable is terminated for electrical connection, said first section being at said first terminal end of said cable, and said second section includes a longitudinal section being intermediate said first terminal end and said second terminal end.

4. The cable of claim 1 including a conductor breakout where said signal conductors are excluded from said woven fabric and are disposed outside of said woven fabric, said warp and weft yarns being continued in a tight weave with said conductors removed, and said tight weave including said warp and weft yarns woven with a spacing which is closer together than the spacing of said warp and weft yarns in said weave of said woven fabric wherein said conductors are included.

5. The cable of claim 4 wherein said tight weave forms a strain relief tab.

6. The cable of claim 1 wherein said cable tapers gradually from said first section to said second section.

7. The cable of claim 1 wherein said center spacing of said signal conductors is compressed and expanded along the length of said cable to contour said cable for routing through an associated chassis.

8. The cable of claim 1 wherein said center spacing of said signal conductors is compressed at said first section to provide a cable which fits into a strain relief opening of an associated electrical connector.

9. The cable of claim 8 wherein said center spacing of said signal conductors is expanded at said second section to provide a center spacing which is greater than said center spacing at said first section to match a series of connector pads carried by said connector.

10. A flat ribbon cable having a plurality of signal conductors extending in a longitudinal direction and arranged in a generally parallel manner with a desired center spacing between centers of said signal conductors, means fixing said center spacing of said signal conductors, wherein said cable comprises:

a compressed width including said signal conductors having a first center spacing;

an expanded width including said signal conductors having a second center spacing which is greater than said first center spacing; and said cable having a first electrical characteristic impedance at said compressed width, and a second electrical characteristic impedance at said expanded width to facilitate matching of electrical characteristics of associated external devices; and a plurality of longitudinal warp yarns and transverse weft yarns woven with said signal conductors to form a woven fabric which fixes the center spacing of said conductors.

11. The cable of claim 10 wherein said cable is adapted for connection to an input device at a first cable end having said compressed cable width, and said cable adapted to be connected at an output device at a second cable end having said expanded cable width, and said first and second electrical impedances matching impedances of said input and output devices.

12. The cable of claim 10 including a first connector for terminating a first end of said cable for electrical connection; a second connector terminating a second end of said cable for electrical connections, said first end having a width for termination to said first connector, and said second end having said expanded width for termination to said second connector.

13. The cable of claim 10 wherein said cable includes a polymeric material in which said signal conductors are encapsulated to fix said center spacing of said signal conductors.

14. The cable of claim 10 wherein said cable has a first end for termination at a first electrical connector, a second end for termination at a second electrical connector, said cable having a compressed width at said first and second ends, and said cable having said expanded width intermediate said first and second ends to provide a low capacitance characteristic.

15. The cable of claim 14 wherein said signal conductors comprise resistive conductors.

16. A woven electrical transmission cable having different widths to provide variable mechanical and electrical characteristics comprising:

a plurality of signal conductors extending in a longitudinal direction in a generally side-by-side manner with a prescribed center spacing between the centers of said signal conductors;

a plurality of warp yarns extending in a longitudinal direction and weft yarns extending in a transverse direction, said warp and weft yarns being woven with said longitudinal signal conductors to form a woven fabric and fix said center spacing of said signal conductors;

a compressed section of said cable in which said signal conductors have a compressed center spacing;

an expanded section of said signal conductors in which said signal conductors have an expanded center spacing, and said expanded center spacing is greater than said compressed center spacing; and terminal means for connecting a first end of said cable to an input device, and for connecting a second end of said cable to an output device.

17. The cable of claim 16 wherein said signal conductors and warp and weft yarns are woven in a multi-layer configuration in said compressed section.

18. The cable of cable 17 wherein said signal conductors and said warp and weft yarns are woven in a single layer construction in said expanded section.

19. The cable of claim 16 including a conductor break-out where said signal conductors are excluded from said woven fabric and are disposed outside of said woven fabric, said warp and weft yarns being continued in a tight weave with said conductors removed, and said tight weave including said warp and weft yarns woven with a spacing which is closer together than the spacing of said warp and weft yarns in said weave of said woven fabric wherein said conductors are included.

20. The cable of claim 19 wherein said tight weave forms a strain relief tab.

21. The cable of claim 16 including a plurality of ground conductors extending in said longitudinal direction in a generally side-by-side manner on opposed sides of said signal conductors.

22. The cable of claim 21 wherein said ground conductors include a pair of juxtaposed ground conductors on each side of said signal conductors.

23. The cable of claim 22 wherein said signal conductors include resistive conductors.

24. A method of matching electrical characteristics and mechanical characteristics of an electrical transmission cable to associated input and output devices and connector assemblies, respectively, said cable being of the type which includes a plurality of signal conductors extending in a longitudinal direction in a generally side-by-side manner with a prescribed center spacing between the centers of said signal conductors, said method comprising:

spacing said signal conductors in a first section of said cable to provide a first center spacing and an electrical characteristic which matches an electrical characteristic of said input device;

spacing said signal conductors in a second section of said cable to provide a second center spacing and an electrical characteristic which matches an electrical characteristic of said output device; and fixing said first and second center spacings of said cable by weaving a plurality of warp yarns in a longitudinal direction and weft yarns in a transverse direction with said signal conductors.

25. The method of claim 24 including weaving said cable to fix said center spacing of said signal conductors where said center spacing is greater in said second section than in said first section.

26. The method of claim 25 including weaving said cable so that it tapers outwardly from said first section to said second section.

27. The method of claim 24 including weaving said cable so that said first section exists at first and second terminal ends of said cable and said second section is woven intermediate said first and second end.

28. A method of matching electrical characteristics and mechanical characteristics of an electrical transmission cable to associated electrical connectors and input and output devices, said cable being of the type which includes a plurality of signal conductors extending in a longitudinal direction in a generally side-by-side manner with a prescribed center spacing between the centers of said signal conductors, said method comprising:

spacing said signal conductors in a first section of said cable to provide a first center spacing and an electrical characteristic which matches an electrical characteristic of said input device;

spacing said signal conductors in a second section of said cable to provide a second center spacing and an electrical characteristic which matches an electrical characteristic of said output device; and fixing said first and second center spacings of said cable; and weaving said cable so that the center spacing of said first section is less than the center spacing in said second section, and fixing said center spacing of said signal conductors in said second section to match the physical dimensions of electrical pads of an associated printed circuit board on which said signal conductors are to be terminated.

29. The method of claim 28 including weaving said second section near said first section to accommodate a mechanical strain relief slot in said electrical connector to which said cable is to be connected near said electrical pads.

* * * * *